US008831480B2

(12) United States Patent
Soda et al.

(10) Patent No.: US 8,831,480 B2
(45) Date of Patent: Sep. 9, 2014

(54) IMAGE FORMING APPARATUS

(75) Inventors: Shota Soda, Kashiwa (JP); Jiro Kinokuni, Abiko (JP); Michihiro Yoshida, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 231 days.

(21) Appl. No.: 13/476,248

(22) Filed: May 21, 2012

(65) Prior Publication Data

US 2012/0301166 A1 Nov. 29, 2012

(30) Foreign Application Priority Data

May 26, 2011 (JP) ..... 2011-118273

(51) Int. Cl.
*G03G 21/00* (2006.01)

(52) U.S. Cl.
USPC ..... 399/129

(58) Field of Classification Search
CPC ..... G03G 15/161; G03G 15/0047; G03G 15/0064
USPC ..... 399/129
See application file for complete search history.

(56) References Cited

U.S. PATENT DOCUMENTS 6,459,872 B1 10/2002 Komiya et al.
2007/0059000 A1 * 3/2007 Shibuya ..... 399/44

FOREIGN PATENT DOCUMENTS

JP 2001-92330 A 4/2001

* cited by examiner

*Primary Examiner* — Walter L Lindsay, Jr.
*Assistant Examiner* — Frederick Wenderoth
(74) *Attorney, Agent, or Firm* — Fitzpatrick, Cella, Harper & Scinto

(57) ABSTRACT

An image forming apparatus includes: a drum; a charger; a developing portion; a transfer portion; a first adjuster; a second adjuster; and a controller for controlling the first and second adjuster. A first voltage is applied to the first adjuster during a period from a time when a rear end of a region in which an electrostatic image corresponding to a final image is to be formed passes through the first adjuster until a time when the rear end passes through the charger. The first voltage is lower in absolute value than a voltage applied to the first adjuster. A second voltage is applied to the second adjuster when a front end of a region of the drum opposing the first adjuster to which the first voltage is applied reaches the second adjuster. The second voltage is higher in absolute value than the voltage applied to the second adjuster.

2 Claims, 9 Drawing Sheets

IMAGE FORMING APPARATUS

FIELD OF THE INVENTION AND RELATED ART

The present invention relates to an image forming apparatus of an electrophotographic type using a cleaner-less type.

In recent years, the image forming apparatus of the cleaner-less type in which an electric charge of a transfer residual toner remaining on a photosensitive member without being transferred is adjusted and then is collected by a developing device has been commercialized. The image forming apparatus of the cleaner-less type includes an adjusting member, for adjusting the electric charge of the toner in contact to the transfer residual toner remaining on the photosensitive member, at a position downstream of a transfer means and upstream of a charging means with respect to a rotational direction of the photosensitive member.

Here, the adjusting member adjusts the charge by contacting the toner and therefore the toner is accumulated on the adjusting member with continuous image formation. When the toner is excessively accumulated on the adjusting member, the toner electric charge cannot be sufficiently adjusted by the adjusting member. Therefore, Japanese Laid-Open Patent Application No. 2001-092330 discloses a constitution in which a cleaning sequence for discharging (moving) a toner deposited on an auxiliary brush onto a photosensitive member after completion of image formation.

On the other hand, toners remaining on the photosensitive member after transfer include a positive(-polarity) toner and a negative(-polarity) toner in mixture. With respect to the toners, a constitution in which two adjusting members including a member for uniformizing the polarities of the toners present in mixture and a member for providing the electric charge so that the toners are collected has been known. Specifically, a constitution provided with a first adjusting member for uniformizing the polarities of the toners present in mixture and a second adjusting member, provided downstream of the first adjusting member, to which a voltage of a polarity identical to a normal charge polarity of the toner has been known.

In the constitution provided with the plurality of the adjusting members, on the first adjusting member disposed close to a transfer portion, compared with the second adjusting member disposed downstream of the first adjusting member, the toner is liable to be accumulated since the first adjusting member adjusts the electric charges of the toners of different polarities present in mixture. The toner is deposited in a large amount and therefore it would be considered that an execution frequency of the cleaning sequence for discharging the toner accumulating on the first adjusting member onto the photosensitive member is increased.

However, when the cleaning sequence is frequently performed, a deterioration of the photosensitive member by energization and a lowering in productivity with the execution of the sequence are caused. Therefore, the present inventors studied whether or not a toner deposition amount itself on the first adjusting member can be reduced.

In a conventional image forming apparatus, at the time of completion of the continuous image formation, a voltage was applied to the first adjusting member until the transfer residual toner for a final toner image to be outputted onto a recording material (an image to be formed on a final page of continuous images) passes through the first adjusting member. On the other hand, the present inventors considered that the amount of the toner deposited on the first adjusting member is reduced by lowering the voltage applied to the first adjusting member within a range adversely affecting the image outputted onto the recording material in order to reduce the amount of the toner deposited on the first adjusting member.

Specifically, the present inventors considered that the voltage is lowered, in order to suppress the toner deposited on the first adjusting member, after a rear end of a region (where the image has not yet been formed) in which the final toner image to be outputted onto the recording material is to be formed passes through the first adjusting member and before a transfer residual toner with respect to the final toner image passes through the first adjusting member.

However, when a low voltage is applied to the first adjusting member, during passing of a region of the photosensitive member, contacting the first adjusting member to which the low voltage is applied, through an opposing portion where the photosensitive member region opposes the second adjusting member, a current passing from the second adjusting member through the photosensitive member is decreased. As a result, there arose a problem that the transfer residual toner remains on the photosensitive member without being collected by the developing means (device).

SUMMARY OF THE INVENTION

The present invention has accomplished solving the above problem.

According to an aspect of the present invention, there is provided an image forming apparatus comprising: an image bearing member; charging means for electrically charging the image bearing member; developing means for developing with a toner an electrostatic image formed on the image bearing member simultaneously with collection of the toner remaining on the image bearing member; transfer means for transferring a toner image, formed on the image bearing member, onto a toner image receiving material; a first adjusting member, provided downstream of the transfer means and upstream of the charging means with respect to a rotational direction of the image bearing member, for adjusting an electric charge of the toner remaining on the image bearing member; a second adjusting member, provided downstream of the first adjusting member and upstream of the charging means with respect to the rotational direction, for adjusting the electric charge of the toner by being supplied with a voltage of a polarity identical to a normal charge polarity of the toner; and control means for controlling said first adjusting member and said second adjusting member, wherein a predetermined first voltage is applied to the first adjusting member during a period from a time when a rear end of a region in which the electrostatic image corresponding to an image, of a series of images designated by a job, to be finally transferred onto the toner image receiving member is to be formed passes through the first adjusting member until a time when the rear end passes through the charging means, wherein the predetermined first voltage is lower in absolute value than a voltage applied to said first adjusting member until the time when the rear end passes through said first adjusting member, and wherein a predetermined second voltage is applied to the second adjusting member when a front end of a region of the image bearing member opposing the first adjusting member to which the predetermined first voltage is applied reaches the second adjusting member, wherein the predetermined second voltage is higher in absolute value than the voltage applied to the second adjusting member until the time when the front end reaches the second adjusting member.

These and other objects, features and advantages of the present invention will become more apparent upon a consideration of the following description of the preferred embodiments of the present invention taken in conjunction with the accompanying drawings.

Figure 4:
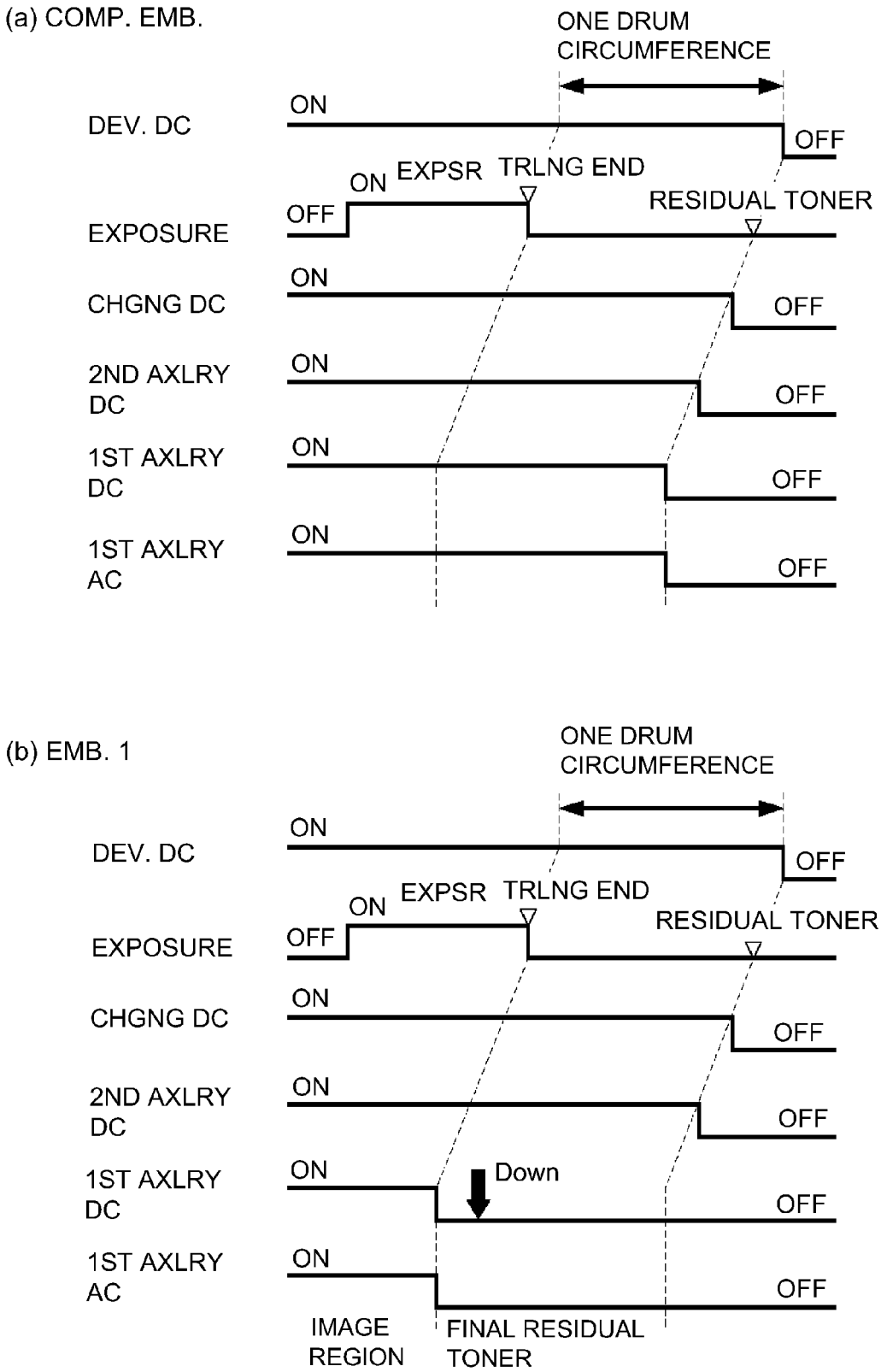

Part (a) of FIG. 4 is a timing chart of an output of a high voltage falling (lowering) mode in a conventional embodiment, and (b) of FIG. 4 is a timing chart of an output of a high voltage falling mode in the present invention.

Figure 5:
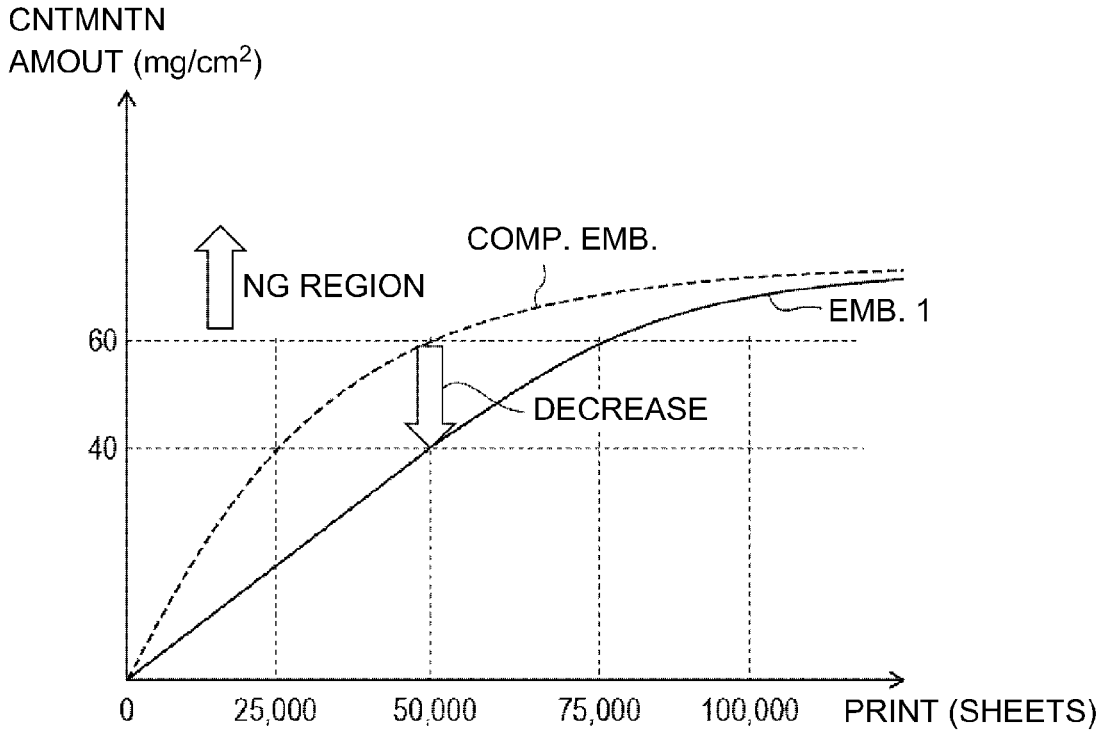

FIG. 5 is a graph showing a result of comparison between the conventional embodiment and the present invention with respect to a contamination amount by toner deposition on a first auxiliary charging brush.

Figure 6:
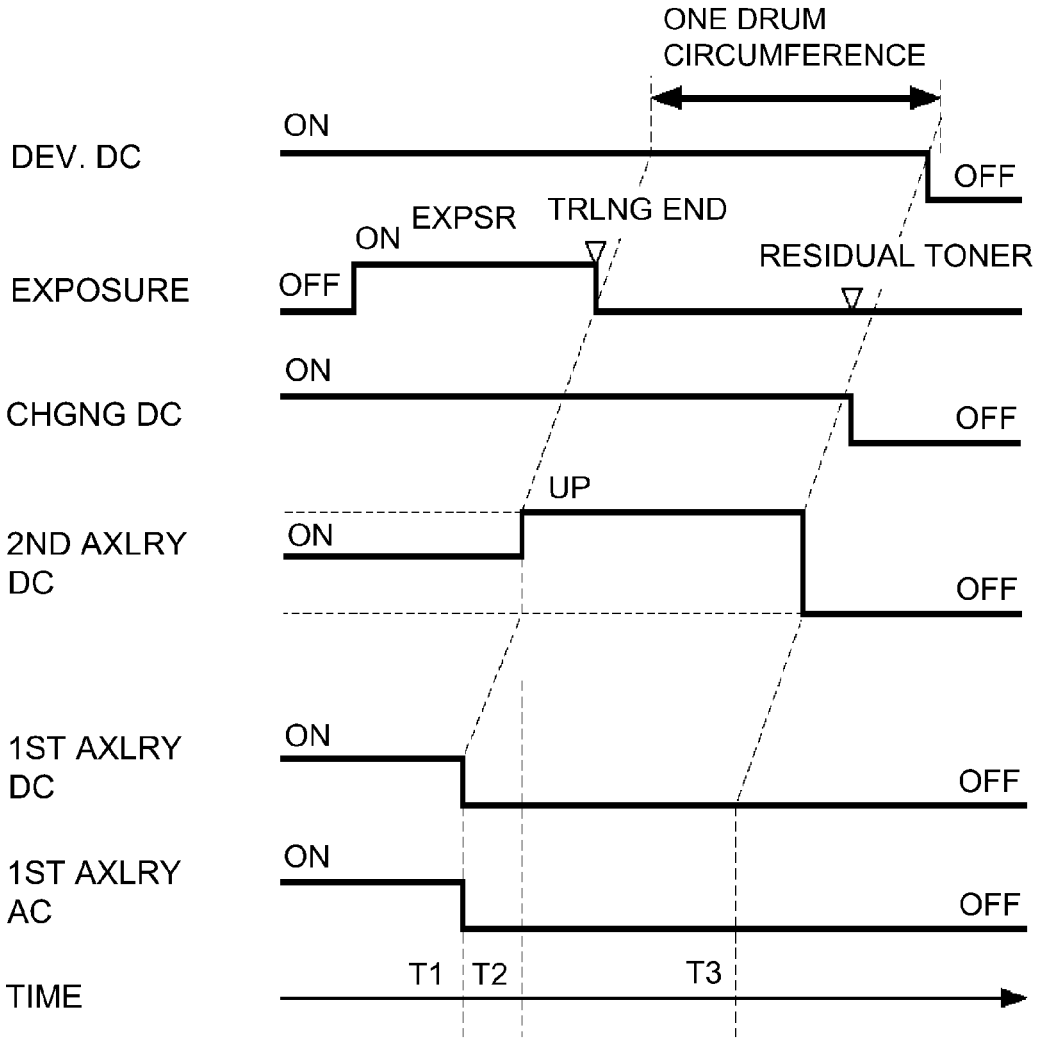

FIG. 6 is a timing chart of an output of a high voltage falling mode in the present invention.

Figure 7:
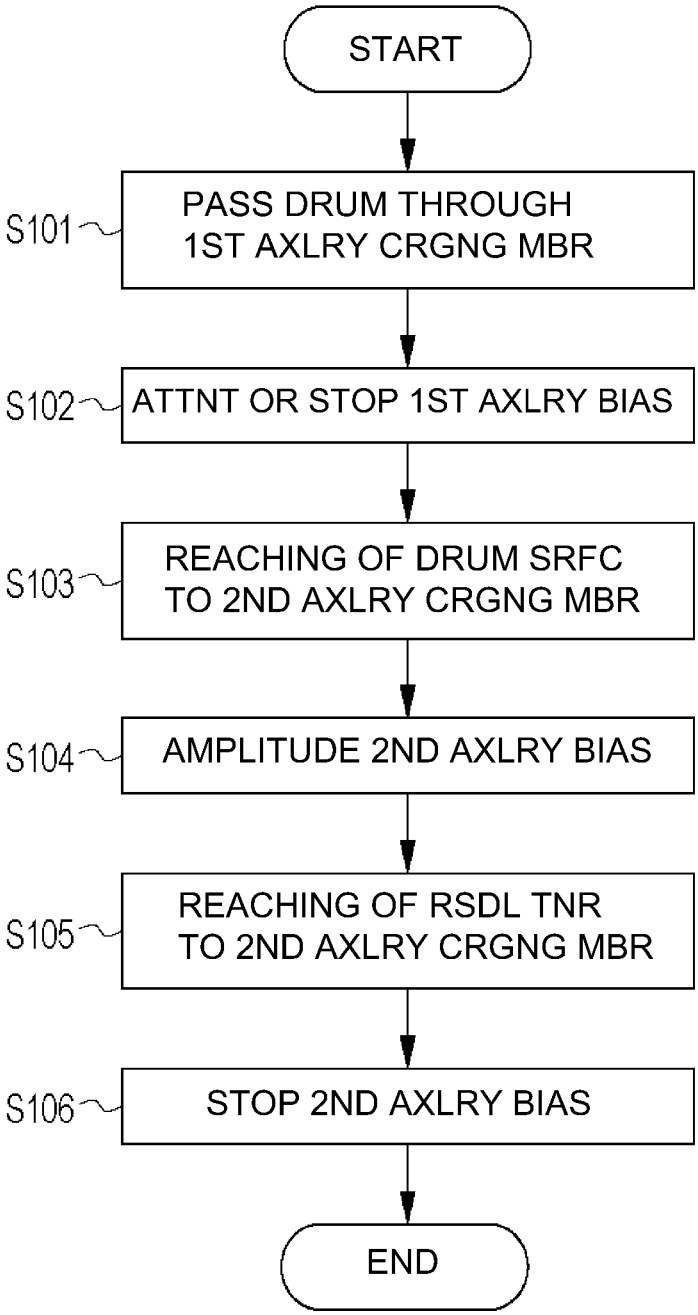

FIG. 7 is a flow chart of the output in the high voltage falling mode in the present invention.

Figure 8:
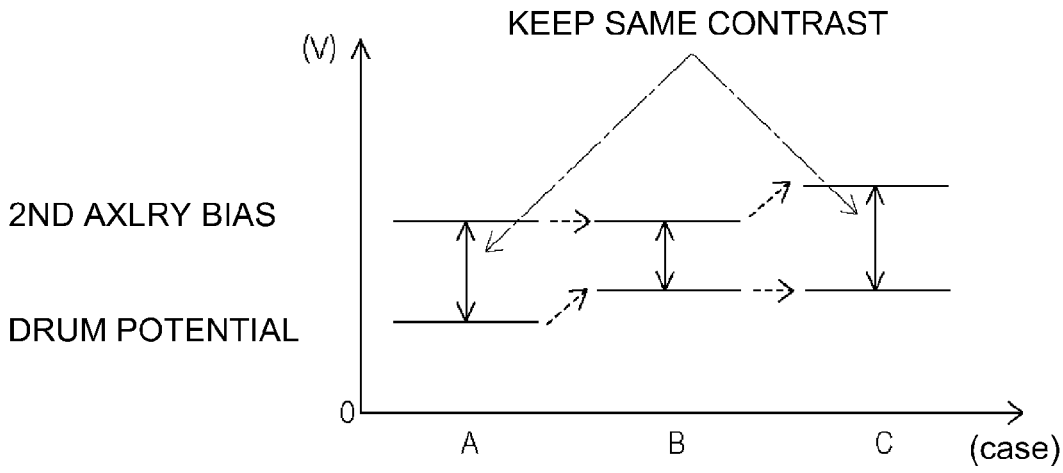

FIG. 8 is a graph for illustrating a potential contrast in each of sequences.

Figure 9:
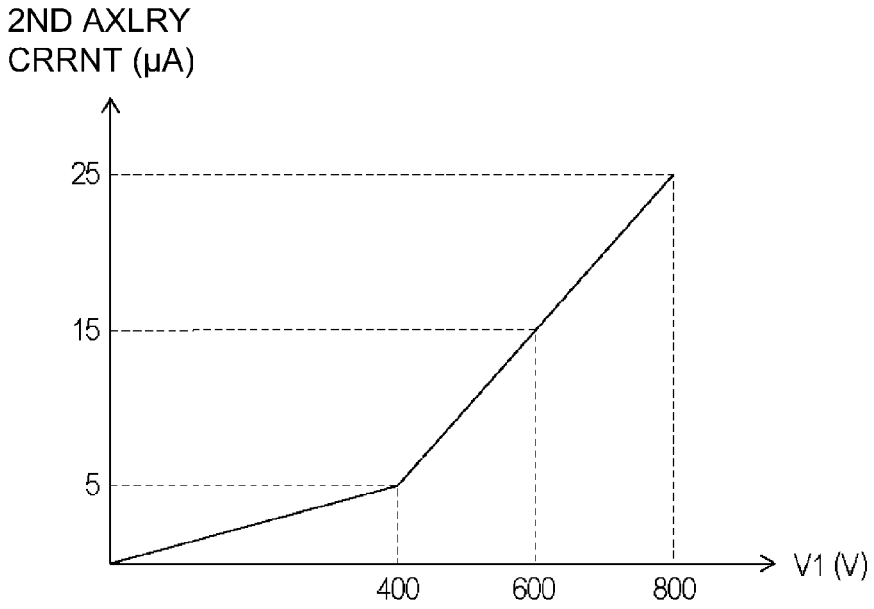

FIG. 9 is a graph showing a voltage-current (V-I) characteristic of a second auxiliary charging member.

Figure 10:
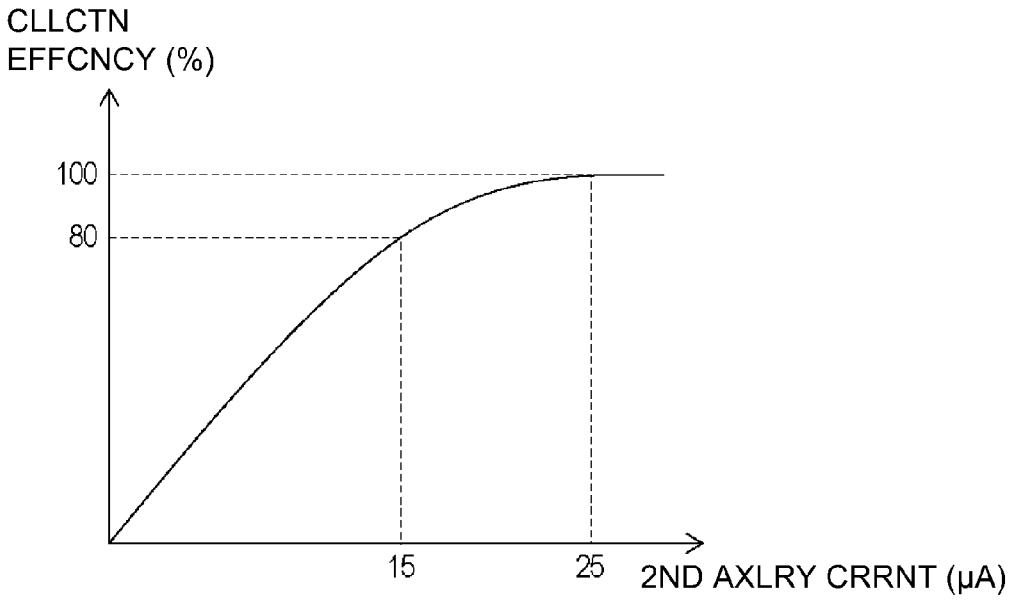

FIG. 10 is a graph showing a relationship between an amount of a current passing through the second auxiliary charging member and a developer collecting rate (property).

Figure 11:
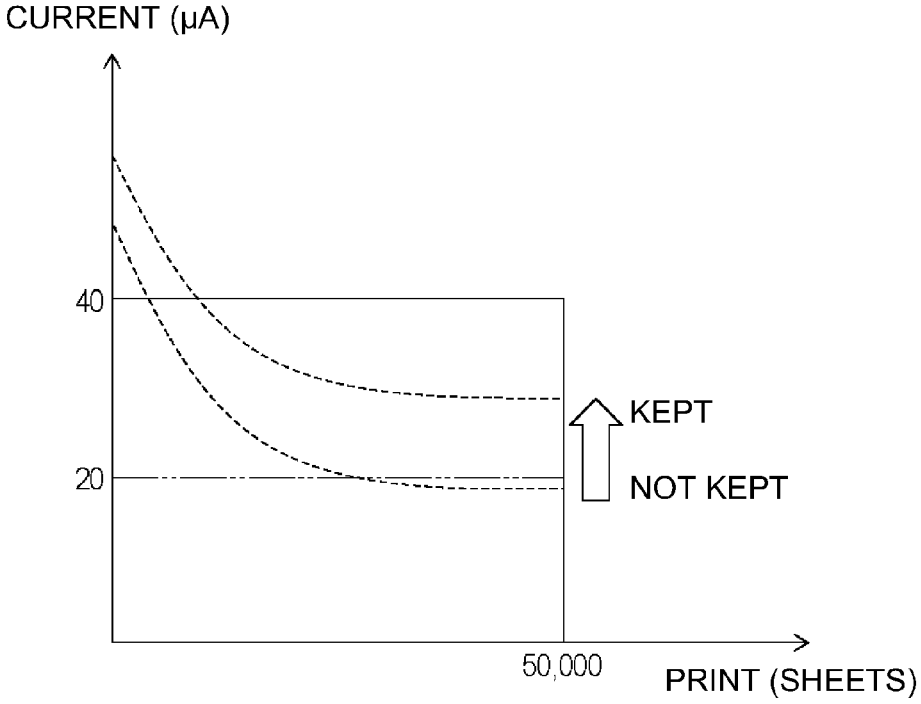

FIG. 11 is a graph showing a result of comparison between the conventional embodiment and the present invention with respect to the amount of the current passing through the second auxiliary charging member.

DESCRIPTION OF THE PREFERRED EMBODIMENTS

Hereinbelow, with reference to the drawings, the image forming apparatus of the present invention will be described based on embodiments. However, dimensions, materials, shapes and relative configurations of constituent elements described in the following embodiments should be appropriately changed depending on constitutions and various conditions of the image forming apparatus to which a concept of the present invention is applied. Therefore, unless otherwise noted specifically, the scope of the present invention is not limited to those in the following embodiments.

Embodiment 1

1. Schematic Structure of Image Forming Apparatus

Figure 1:
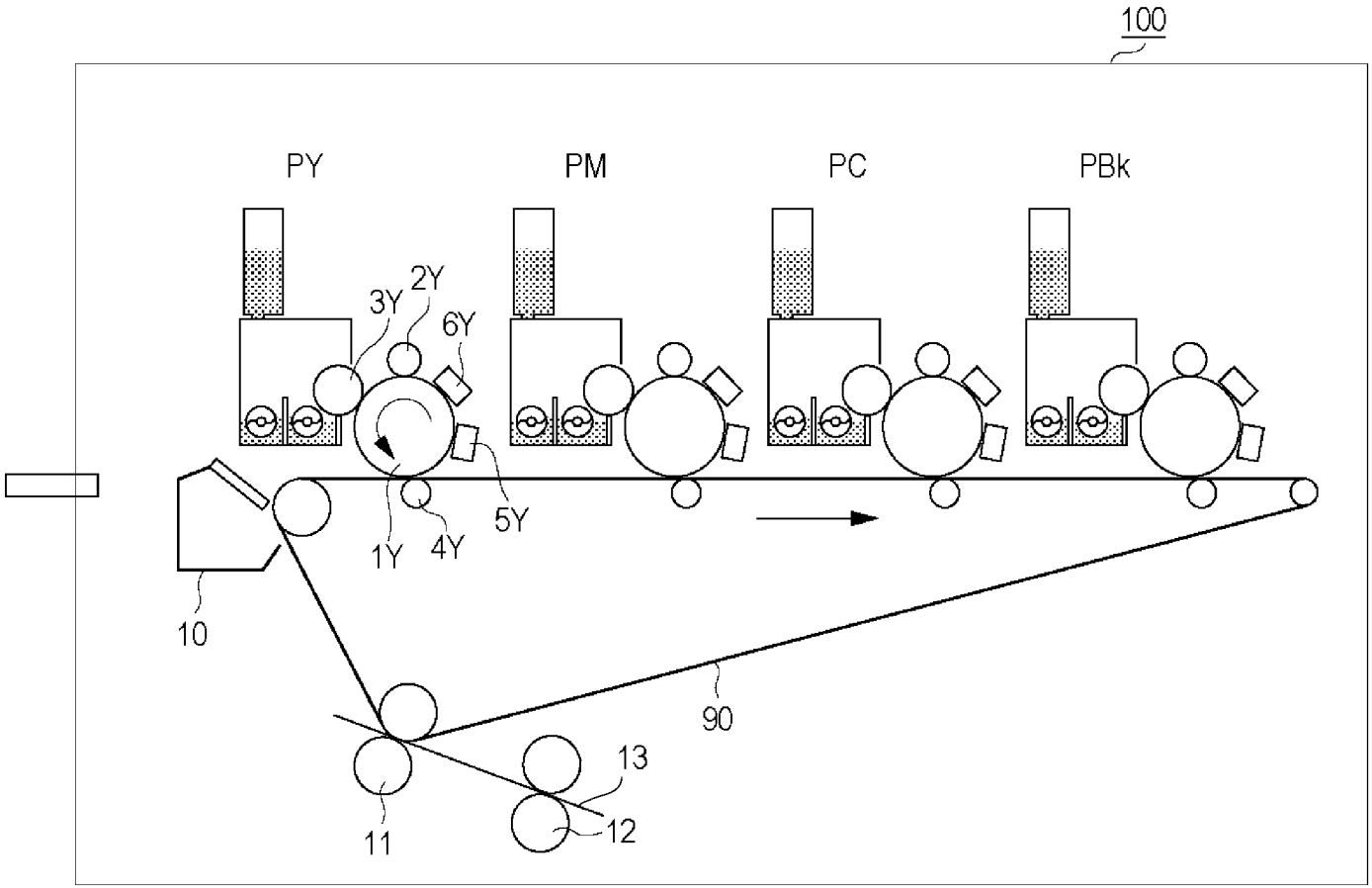
FIG. 1 is a schematic illustration of an image forming apparatus.

FIG. 1 is a schematic view for illustrating a schematic structure of an image forming apparatus in this embodiment. An image forming apparatus 100 includes process cartridges PY, PM, PC and PBk for a plurality of colors and form toner images on the same transfer material 13 by successively transferring superposedly the toner images onto the transfer material 13. Further, the image forming apparatus 100 includes an intermediary transfer belt (hereinafter referred to as ITB) 90 as a toner image receiving material (intermediary transfer member) and a cleaning blade 10. The ITB 90 moves in an arrow direction. The transfer material 13 taken out of an unshown sheet feeding cassette is supplied to a secondary transfer portion, formed between the ITB 90 and a transfer roller 11, via a registration roller 12. On the ITB 90 with respect to the direction of gravitation, the four image forming portions (process cartridges) PY, PM, PC and PBk are provided in contact to the ITB 90. Incidentally, in a constitution in which the toner images formed on image bearing members are directly transferred onto a recording material, the recording material is the toner image receiving material.

These image forming portions PY, PM, PC and PBk form on the ITB 90 the toner images of yellow, magenta, cyan and black, respectively. Further, the toner remaining on the ITB 90 without being transferred onto the recording material is removed by the cleaning blade 10. The transfer material (recording material or recording paper) 13 on which the toner images are transferred is conveyed to a fixing device by an unshown conveying belt. The fixing device including a pair of heating rollers fixes the toner images on the surface of the conveyed recording paper 13 and then discharges the image formed recording paper 13 to the outside of the image forming apparatus 100. Constitutions of the process cartridges (image forming portions) PY, PM, PC and PBk are basically the same and therefore in the following, the same constitution of the process cartridges will be described by collectively referring the process cartridges as a process cartridge P.

2. Schematic Structure of Image Forming Portion

Figure 2:
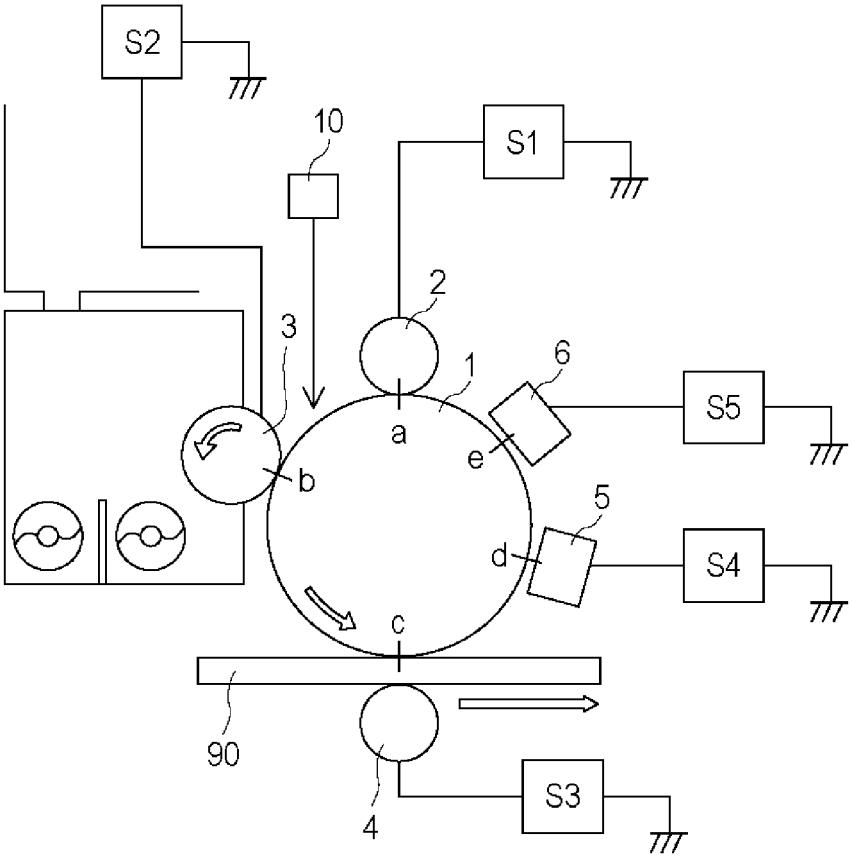
FIG. 2 is a schematic illustration of an image forming portion.

FIG. 2 is a schematic view for illustrating a structure of the process cartridge P as the image forming portion in this embodiment.

A photosensitive drum 1 as a cylindrical image bearing member (photosensitive member) is rotationally driven in an arrow direction at a predetermined peripheral speed. Then, a charging bias is applied to a charging roller 2 as a charging member (charging means) contacting the photosensitive drum 1, so that the photosensitive drum 1 is electrically charged to a predetermined potential. To the charging roller 2, a predetermined charging bias is applied from a bias voltage source (power source) S1.

The charged photosensitive drum 1 is exposed to (laser) light by a laser scanner 10 as an electrostatic image forming means, so that an electrostatic image is formed on the photosensitive drum (photosensitive member) 1. The photosensitive drum surface is lowered in potential at an exposed portion (light portion) and keeps a charge potential at an unexposed portion (dark portion). As a result, an electrostatic latent image corresponding to imagewise exposure by the lower scanner 10 is formed on the photosensitive drum 1.

Then, the electrostatic image is developed at a downstream side of the exposure portion. Specifically, the electrostatic image is developed with a toner by applying a predetermined developing bias from a bias voltage source S2 to a developing sleeve roller 3 provided in a developing device in which a developer containing the toner and a carrier is accommodated. Incidentally, an opposing portion between the developing sleeve roller 3 as a developing member and the photosensitive drum 1 is referred to as a developing portion (developing nip) b. In this embodiment, in the developing device, a pulverization toner is accommodated. In the case where the pulverization toner is used, the amount of the toner deposited and accumulated on an auxiliary charging brush as an adjusting member for adjusting the electric charge of the toner is increased.

The toner image developed by the developing means is transferred, at a transfer portion, onto the intermediary transfer belt (ITB) 90 as the toner image receiving material (member). Specifically, the toner image is transferred from the photosensitive drum 1 onto the ITB 90 by applying a predetermined transfer bias from a bias voltage source S3 to a transfer roller 4 as a transfer means. Here, a transfer portion (transfer nip) c where the toner image is transferred onto the ITB 90 is formed by press-contact of the transfer roller 4 to the ITB 90 toward the photosensitive drum 1. Incidentally, in order to transfer the toner image onto the ITB 90 to the transfer roller 4, a voltage of a polarity opposite to a normal charge polarity of the toner is applied.

Further, a transfer residual toner remaining on the surface of the photosensitive drum 1 after the toner image transfer reaches the developing portion b via a charge portion a by continuous rotation of the photosensitive drum 1, thus being subjected to "simultaneous development and collection (cleaning)" by the developing device 3. The simultaneous development and collection is such a method that the transfer residual toner remaining on the photosensitive drum 1 after the transfer is collected by the developing device 3 by providing a fog-removing potential difference (Vback) which is a fog-removing bias (potential difference between a DC voltage applied to the developing means and a surface potential of the develop) during subsequent or later development after the transfer.

This simultaneous development and cleaning is effected together with an image forming process including charging, exposure, development and transfer in the case where an image region with respect to a rotational direction of the photosensitive drum 1 is longer than one-full-circumference of the photosensitive drum 1.

In order to effect the simultaneous development and cleaning, the image forming apparatus includes an adjusting means, provided downstream of the transfer portion and upstream of the charging portion, for adjusting the electric charge of the toner. The adjusting means in this embodiment is consisting of two members including a first adjusting member for performing the function of uniformizing the positive and negative polarities of the toners at the transfer portion and a second adjusting member for performing the function of providing the electric charge such that the polarity-uniformized toners are collected by the developing device.

An auxiliary charging brush 5 as the first adjusting member is provided downstream of the transfer portion c and upstream of the charging portion a. Further, an auxiliary charging brush 6 as the second adjusting member is provided downstream of the first adjusting member and upstream of the charging portion a. In this embodiment, the auxiliary charging brushes 5 and 6 are disposed in contact to the photosensitive member. Incidentally, the auxiliary charging brushes 5 and 6 may also be disposed in proximity to the photosensitive member so long as they can adjust the toner electric charge.

A voltage of a polarity opposite to the normal charge polarity of the toner is applied from a bias voltage source S4 to the auxiliary charging brush 5, and at a first adjusting portion (first auxiliary charging nip) d of the photosensitive drum 1, the toner remaining on the photosensitive member is temporarily taken into (onto) the auxiliary charging brush 5. The toners remaining on the photosensitive member at the downstream side of the transfer portion are influenced by the voltage applied to the transfer portion and include the toner of a polarity identical to the normal charge polarity and the toner of a polarity opposite to the normal charge polarity of the toner in mixture.

The toners taken from the photosensitive drum 1 into the auxiliary charging brush 5 as the first adjusting member are, after their polarities are uniformized, electrostatically discharged (moved) onto the photosensitive drum 1 in a recharged state.

Further, the image forming portion includes the auxiliary charging brush 6 as the second adjusting member downstream of the first adjusting member and upstream of the charging means. To the auxiliary charging brush 6, a voltage of a polarity identical to the normal charge polarity of the toner is applied, so that the auxiliary charging brush 6 provides the electric charge, to the charge-uniformized toners by the auxiliary charging brush 6, such that the toners are subjected to the simultaneous development and collection (cleaning) by the developing device.

Specifically, at a second adjusting portion (second auxiliary charging nip) e formed between the auxiliary charging brush 6 and the photosensitive drum 1, the toners are supplied with predetermined electric charges of the normal toner charge polarity. Then, the toners which are electrostatically discharged (moved) from the auxiliary charging brush 6 and are charged to the normal toner charge polarity pass through the charging portion a and are, at the developing portion b, collected and developed simultaneously by the developing means 3. The above is a schematic constitution of the image forming apparatus.

Incidentally, in this embodiment, a nylon 12 brush of about $10^5$ Ω·cm was used as the upstream auxiliary charging brush 5, and a nylon brush of about $10^5$ Ω·cm was used as the downstream auxiliary charging brush 6.

3. Operation after Completion of Image Formation

Hereinafter, connection relationships among respective portions of the image forming apparatus in the above-described constitution will be described and thereafter a sequence from the completion of the image formation to a stand-by state will be described.

(Block Diagram)

Figure 3:
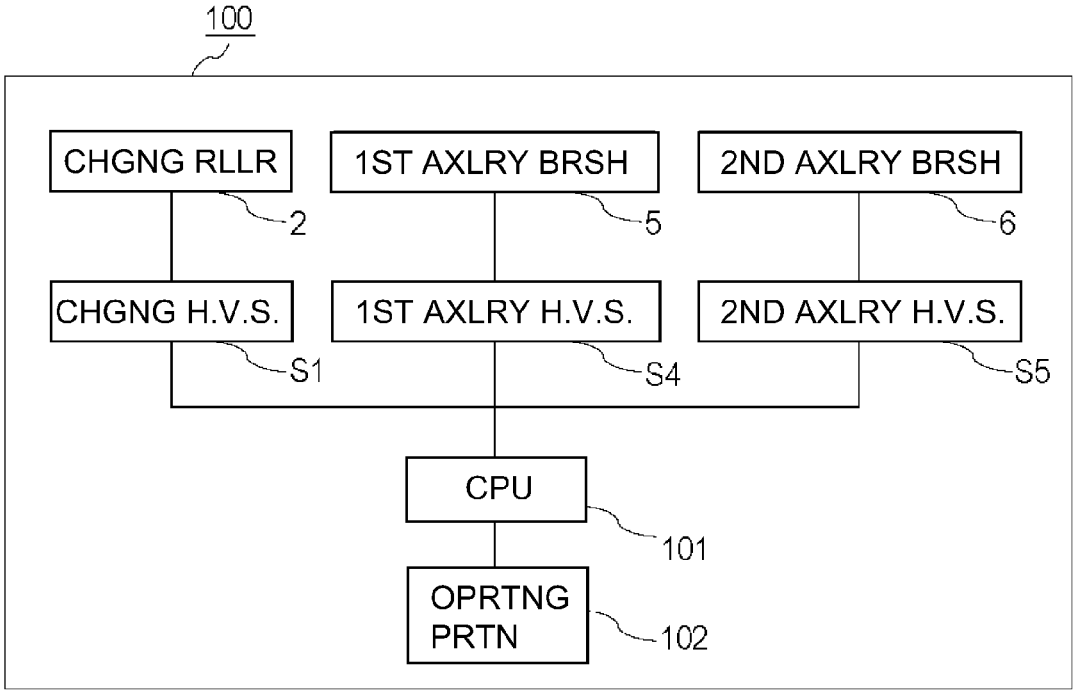
FIG. 3 is a block diagram of a control device of the image forming apparatus.

FIG. 3 is a block diagram for illustrating the connection relationships among the respective portions of the image forming apparatus. The image forming apparatus 100 includes a touch panel 102 as an operating portion for receiving an input from a user and a CPU (central processing unit) 101 as a control means for controlling the respective portions of the image forming apparatus. The CPU 101 controls the respective portions of the image forming apparatus in accordance with a program stored in RAM (random access memory). As a result, the image forming apparatus performs outputs along a timing chart and a flow chart which are described later. Then, the sequence when the image formation is ended will be described along the flow chart.

Comparative Embodiment

Conventional High-Voltage Falling Sequence

In the following, conventional high-voltage falling (lowering) timing in Comparative Embodiment will be described. High voltages are applied to respective portions (elements) of the image forming portion during continuous image formation but in order to suppress unnecessary electric power consumption, in a stand-by state, it is preferable that the high voltages are not applied (turned off). Part (a) of FIG. 4 is a timing chart for illustrating high-voltage falling timing of each of voltages applied to the charging roller, the auxiliary charging brushes and the like in a conventional embodiment as Comparative Embodiment. Each of oblique broken lines drawn to connect respective elements in the timing chart presents that the same region of the photosensitive member opposes associated elements each with indicated (intersecting) timing with rotation of the photosensitive member. A double-pointed arrow between the oblique broken lines in the timing chart represents one-full-circumference of the photosensitive drum.

During continuous image formation, a predetermined bias is applied to each of the charging means, the exposure means, the developing means and the auxiliary charging brushes. Then, in accordance with a print job inputted as a series of continuous image forming commands, the image forming apparatus subjects the charged photosensitive member to light exposure to form an image.

In the conventional embodiment, when the image formation is ended, the voltage applied to the first auxiliary charging brush is turned off after the electric charge of the transfer residual toner with respect to an image outputted on the final page is adjusted by the first auxiliary charging brush. That is, the application of the applied voltage during image formation is terminated in synchronism with timing when a trailing end (edge) of the image transferred on the intermediary transfer belt passes through the first auxiliary charging brush. Then, the CPU 101 successively falls (turns off) the respective high voltages in order to transfer the state of the image forming apparatus to the stand-by state. Specifically, in accordance with the commands from the CPU 101, the voltages applied to the respective voltage sources S1 to S5 are switched from ON to OFF.

In succession to the high-voltage OFF of the first auxiliary high-voltage source S4, the high-voltage application from the second auxiliary high-voltage source S5 to the second auxiliary charging member 6 is stopped. Incidentally, the applications of the high AC voltage and high DC voltage from the first auxiliary high-voltage source S4 to the first auxiliary charging member 5 are stopped simultaneously. Then, the applications of the high voltages (high AC voltage and high DC voltage) from the charging high-voltage source to the charging device and the application of the high voltage from the developing high-voltage source to the developing device are stopped.

Incidentally, during image formation, a DC voltage of −800 V is applied to the charging roller. Further, to the first auxiliary charging brush, a DC voltage of 600 V and an AC voltage of 400 V are applied. Further, to the second auxiliary charging brush, a DC voltage of −1000 V is applied. Here, the potential of the develop surface passing through the opposing portion to the first auxiliary charging brush to which the above bias is applied is −200 V. Therefore, in the conventional embodiment, a potential contrast (V1) between the photosensitive drum and the second auxiliary charging brush is 800 V.

In the sequence described in the conventional embodiment, the bias application is stopped at the time when the transfer residual toner at a trailing end of the image to be outputted on the final page passes through the first auxiliary charging brush. For that reason, the first auxiliary charging brush also recharges the transfer residual toner with respect to the image on the final page. In the above-described high-voltage falling sequence, the same auxiliary bias condition as that during the image formation is employed until the transfer residual toner corresponding to the image outputted on the sheet is charged by the auxiliary charging member.

(High-Voltage Falling Sequence in this Embodiment)

A high-voltage falling sequence in this embodiment will be described. The control means in this embodiment controls, in order to reduce a toner deposition amount, the voltage applied to the first auxiliary charging brush after the electric charge of the transfer residual toner deposited on the photosensitive member in a region where the image to be outputted on the final page of continuous images is completely adjusted. That is, a predetermined voltage lower in absolute value than the voltage applied to the first adjusting member until the trailing end passes through the first adjusting member is applied to the first adjusting member.

Specifically, the applied high voltage is lowered (turned off) earlier than the conventional control, whereby the amount of the toner deposited on the first auxiliary charging brush 5 can be decreased. As a result, a frequency of application of the bias for discharging the toner into the first auxiliary charging brush 5 can be reduced and thus a lowering in productivity can be suppressed.

Incidentally, the control in this embodiment is a preferable control since the amount of the toner deposited and accumulated on the first auxiliary charging brush 5 in the constitution using the pulverization toner may also be applied to a constitution using a polymerization toner or the like.

Part (b) of FIG. 4 is a timing chart for illustrating the high-voltage falling sequence in this embodiment. When the transfer residual toner corresponding to the image to be outputted on the final sheet is re-charged by the first auxiliary charging brush 5, the toner is accumulated on the first auxiliary charging brush 5 and therefore an original function of the auxiliary charging brush such that the toner electric charge is adjusted is impaired. As a result, there arises a problem of potential non-uniformity or the like due to the first auxiliary charging brush.

Therefore, as described above, at the time when the region where the final toner image of the toner images to be continuously outputted, i.e., the region where the final electrostatic image is formed on the photosensitive member has passed through the first auxiliary charging brush 5 as the first adjusting member, the bias application to the first auxiliary charging brush 5 is attenuated or stopped. Specifically, as shown in (b) of FIG. 4, the voltage applied to the first auxiliary charging brush is turned off earlier than Comparative Embodiment (conventional embodiment). This timing when the voltage applied to the auxiliary charging brush is turned off is substantially synchronized with the timing of passing of the region to be subjected to the imagewise exposure, so that the toner deposition amount can be reduced.

Incidentally, in order to maintain stability of the photosensitive drum surface potential during the image formation, the timing when the voltage application to the first auxiliary charging brush is turned off may desirably be until the charging step is ended. However, when the timing is until the residual toner at the image trailing end reaches the first auxiliary charging member as the conventional embodiment, the toner deposition amount can be reduced. Hereinafter, a sequence for shortening, compared with Comparative Embodiment, a first auxiliary charging member bias application time is referred to as an "early-(turning)off sequence".

Incidentally, after the sequence shown in FIG. 4, the sequence for discharging the toner deposited on each auxiliary charging brush onto the member may also be performed. When the amount of the toner deposited on the brush is large, a time required for the cleaning is prolonged, so that a time until the image forming apparatus state goes to the stand-by state is also prolonged.

4. Image Evaluation Test 1

Comparative of an effect between the conventional sequence and the "early-off sequence" described above is made.

FIG. 5 is a graph for comparing a deposition amount (contamination amount) of the toner deposited on the first auxiliary charging brush with continuous image formation. Specifically, FIG. 5 is a graph for showing the amount of the toner deposited and accumulated on (in) the first auxiliary charging member at the times of 25,000 sheets, 50,000 sheets, 75,000 sheets and 100,000 sheets as a total number of output sheets (print) when a sheet passing test such that an image with an image duty of 5% is outputted in a 2-sheet intermittent manner is conducted. In FIG. 5, a solid line represents a result in the case where the sequence in this embodiment is employed, and broken line represents a result in the case where the sequence in Comparative Embodiment (conventional embodiment) is employed.

As is apparent from FIG. 5, in the conventional control in which the bias is applied until the trailing (rear) end of the transfer residual toner corresponding to the final image passes through the first auxiliary charging member after the image formation is ended, at the time of 50,000 sheets, the toner deposition (accumulation) amount is 60 mg/cm$^2$.

In a state in which the toner deposition amount of the first auxiliary charging brush 5 exceeds 60 mg/cm$^2$, in the case where the image formation is repeated or the image formation with a high image ratio is continued, image defect resulting from electric discharge non-uniformity occurs.

On the other hand, in the case where the "early-off sequence" described above is employed, the amount of the toner deposited and accumulated on the first auxiliary charging brush 5 at the time of 50,000 sheets can be suppressed to 40 mg/cm$^2$. For that reason, even when the total sheet number exceeds 50,000 sheets, it is possible to suppress the image defect resulting from the electric discharge non-uniformity.

Results of the sheet passing test with respect to the control in this embodiment and the conventional control are summarized in Table 1.

TABLE 1

| | 10,000 | 30,000 | 50,000 (sheets) |
|---|---|---|---|
| COMP. EMB. | ○ | ○ | x |
| EMB. 1 | ○ | Δ | Δ |

Here, in Table 1, "○" represents that a good image is outputted. "Δ" represents that a slight fog image is outputted. "x" represents that an observable defective image is outputted. By employing the early-off sequence in this embodiment, the amount of the toner deposited on the first auxiliary charging brush 5 as the first adjusting member can be reduced. However, an effect of electrically discharging the surface of the photosensitive member after passing through the first auxiliary charging brush 5 is decreased and therefore the surface potential of the photosensitive member after passing through the first auxiliary charging brush 5 is lowered to −400 V. As a result, the potential contrast (V1) between the photosensitive drum 1 and the second auxiliary charging brush 6 to which the voltage of −1000 V is applied is decreased to 600 V. As a result, there arose a problem that the simultaneous development and collection function is lowered.

Embodiment 2

The early-off sequence described in Embodiment 1 can reduce the amount of the toner deposited on the first auxiliary charging brush 5 compared with the conventional embodiment and thus can suppress improper charging for a long period. However, there arose a problem that the potential contrast between the second auxiliary charging brush 6 and the photosensitive drum 1 is changed and thus the developer collecting property becomes poor.

Therefore, in this embodiment, a sequence for suppressing the lowering in developer collecting property by collecting also the voltage applied to the second auxiliary charging brush 6 simultaneously with the voltage applied to the first auxiliary charging brush 5. In the following, constituent members (portions) similar to those in Embodiment 1 are represented by the same reference numerals (symbols) and will be omitted from description.

1. High-Voltage Early-Off Sequence in this Embodiment

In this embodiment, the voltage applied to the second auxiliary charging brush 6 is changed with timing when the region where the photosensitive member surface potential is lowered by early turning off the voltage application to the first auxiliary charging brush 5 passes through the second auxiliary charging brush 6. The sequence will be described along a timing chart and a flow chart.

(Timing Chart)

FIG. 6 is a timing chart for illustrating the high-voltage falling sequence at the time of completion of the image formation in this embodiment. In the timing chart, oblique lines are used for explaining movement of the same region (of the photosensitive member surface) with the rotation of the photosensitive member. Also in the sequence control in this embodiment, the high-voltage application to the first auxiliary charging brush 5 is turned off (lowered to 0 V) earlier than the conventional control, so that the amount of the toner deposited on the first auxiliary charging brush 5 is suppressed.

In order to reduce the toner deposition amount on the first auxiliary charging brush 5 as the first adjusting member, when the applied voltage is changed, earlier than the conventional control, to a voltage (0 V in this embodiment) lower than the voltage applied during the image formation, the surface potential of the photosensitive member is lowered. Then, when a front end of the photosensitive member region passing through the opposing portion to the first auxiliary charging brush 5 to which the predetermined voltage (0 V) lower than the voltage applied during the image formation passes through the second auxiliary charging brush 6, the applied voltage is made higher ("UP" in FIG. 6) than the voltage applied during the image formation ("ON" in FIG. 6). Incidentally, a lowering in transfer residual toner collecting efficiency can be suppressed by increasing the voltage applied to the second auxiliary charging brush 6 in the whole region corresponding to the portion where the voltage applied to the first auxiliary charging brush is lowered. That is, when the front end of the region of the image bearing member opposing the first adjusting member to which the above-described predetermined voltage is applied reaches the second adjusting member a voltage higher in absolute value than the voltage applied to the second adjusting member until the front end reaches the second adjusting member is applied to the second adjusting member.

Here, the voltage applied to the second auxiliary charging member 6 during the "UP" period in FIG. 6 may only be required to be increased correspondingly to the photosensitive member surface potential lowered by decreasing the voltage applied to the first auxiliary charging brush 5. Specifically, a voltage higher than a voltage corresponding to a difference in photosensitive member potential between the time when the voltage applied to the first auxiliary charging brush 5 during the image formation and the time when the voltage of 0 V is applied to the first auxiliary charging brush 5, i.e., higher than the voltage applied during the image formation is applied to the second auxiliary charging brush 6.

(Flow Chart)

The sequence described along the timing chart of FIG. 6 will be supplementarily described along a flow chart. FIG. 7 is the flow chart for illustrating the high-voltage falling sequence during the image formation in this embodiment. When the image forming apparatus state is changed from the state of the end of the image formation to the stand-by state, the CPU 101 as the control means controls the high-voltage sources (S1 to S5) in the following manner in accordance with a program stored in RAM.

The CPU 101 lowers the voltage applied to the first auxiliary charging brush 5 at the time when the rear end of the region in which the electrostatic image the electrostatic image corresponding to an image to be formed on the final page of pages of continuous image formation designated by a job is to be formed passes through the first auxiliary charging brush 5 (S101, S102). As a result, with timing T1 in FIG. 6, applications of the DC voltage and AC voltage which are applied to the first auxiliary charging brush 5 are turned off.

Then, in synchronism with timing (T2) when the region where the photosensitive member surface potential is changed by the first auxiliary charging brush 5 to which the low voltage is applied reaches a position where the region opposes the second auxiliary charging brush 6, the voltage applied to the second auxiliary charging brush 6 is increased (S103, S104).

Then, during one full turn of the photosensitive drum (through one-full-circumference), the voltage higher than the voltage applied during the image formation is applied to the second auxiliary charging brush 6 (S105). In other words, for a period until the transfer residual toner corresponding to the image outputted on the final page passes through the second auxiliary charging brush 6, the voltage higher than the voltage applied during the image formation is applied to the second auxiliary charging brush 6. Thereafter, the high-voltage application to the second auxiliary charging brush 6 is turned off (S106/T3).

Here, when the stop of the application of the bias (voltage) to the first auxiliary charging brush 5 is continued, the potential contrast between the bias applied to the first auxiliary charging brush 5 and the surface potential of the photosensitive drum 1 is decreased to 600 V. For that reason, the bias applied to the second auxiliary charging brush 6 is increased in absolute value from −1000 V (during the image formation) to −1200 V. As a result, the potential contrast (V1) from the photosensitive drum surface potential can be kept at 800 V, so that it is possible to maintain functions of secondary collection, re-charging, and discharging onto the photosensitive member surface of the polarity-inverted toner.

Incidentally, in order to keep the potential contrast, the charge potential (voltage) applied to the second auxiliary charging brush 6 is increased and therefore as a result, the increased charge potential influences the surface potential of the photosensitive member. For that reason, the DC voltage applied to the developing device is changed in order to maintain the collecting property of the transfer residual toner, corresponding to the final page image, into the developing device.

(Potential Contrast V1)

By employing the above-described sequence, the potential contrast (V1) at the opposing portion where the photosensitive drum 1 opposes the second auxiliary charging brush 6 can remain similarly as in the conventional embodiment. Here, the potential contrasts in the case where the sequences in the conventional embodiment, Embodiment 1 and Embodiment 2 (this embodiment) are employed will be described with reference to a schematic view.

FIG. 8 is the schematic view for illustrating the potential contrast when each of the sequences is employed. In FIG. 8, Case A represents the potential contrast when the sequence in the conventional embodiment is employed. In the conventional embodiment, the voltages which are the same as those applied during the image formation are applied to the first auxiliary charging brush 5 and the second auxiliary charging brush 6 until the electric charge adjustment of the transfer residual toner corresponding to the image outputted on the final page. For that reason, the amount of the toner deposited on the first auxiliary charging brush 5 cannot be reduced but the potential contrast can be kept. In FIG. 8, Case B represents the potential contrast when the sequence described in Embodiment 1 is employed.

In order to suppress the amount of the toner deposited on the first auxiliary charging brush 5, the voltage application to the first auxiliary charging brush 5 is turned off and therefore a desired potential contrast (V1) cannot be kept. Further, in FIG. 8, Case C represents the potential contrast when the sequence described in this embodiment is employed. The potential contrast V1 is kept while suppressing the amount of the toner deposited on the first auxiliary charging brush 5.

Further, similarly, a relationship between the potential contrast V1 and the amount of a current passing through the second auxiliary charging brush 6 is shown in FIG. 9. As shown in FIG. 9, the current amount when the potential contrast V1 is 800 V is about 25 μA but on the other hand, the current amount when the potential contrast V1 is 600 V is lowered to 15 μA. Thus, the amount of the current passing through the second auxiliary charging brush 6 is associated with the electric charge supplied to the toner.

FIG. 10 is a graph showing a relationship between the amount of the current passing through the second auxiliary charging brush 6 and the collecting property (efficiency) at the developing portion. As shown in FIG. 10, in a region where the current amount is 25 μA or less, the collecting efficiency is gradually decreased and is lowered to about 80% when the current amount is 15 μA. On the other hand, in a region where the current amount is 25 μA or more, the collecting efficiency is substantially kept at 100%. As a result, by maintaining the amount of the current passing through the second auxiliary charging brush 6, it becomes possible to reduce the deposition (accumulation) amount of the transfer residual toner on the first auxiliary charging member while keeping the collecting efficiency.

2. Image Evaluation Test 2

Comparison of effects among the cases where the sequences in the conventional embodiment, Embodiment 1 and this embodiment are used is made. Specifically, an image with an image duty of 30% was formed in a 2-sheet intermittent manner and then was subjected to a functional evaluation test by eyes. Test results are summarized in Table 2. Further, a result of measurement of the amount of the current passing through the second auxiliary charging brush 6 every predetermined number of sheets subjected to image formation is shown in a graph of FIG. 11.

TABLE 2

| | 10,000 | 30,000 | 50,000 (sheets) |
|---|---|---|---|
| COMP. EMB. | ○ | ○ | x |
| EMB. 1 | ○ | Δ | Δ |
| EMB. 2 | ○ | ○ | ○ |

In Table 2, "○" represents that a good image is outputted. "Δ" represents that a slight fog image is outputted. "x" represents that an observable defective image is outputted. In the conventional embodiment, a clear fog was generated on the image in the neighborhood of 50,000 sheets. Further, when the amount of the current passing through the second auxiliary charging member 6 at that time was measured, the current amount was 17 μA. That is, in the conventional embodiment, it would be considered that the collecting efficiency is lowered to about 80% and thus the transfer residual toner which is not collected by the developing device is moved on the photosensitive drum to cause the fog.

However, in the sequence in this embodiment, the image defect was not generated even when the sheet number exceeds 50,000 sheets. Further, when the amount of the current passing through the second auxiliary charging brush 6 was measured at that time, the current amount was kept at 25 μA. Thus, by employing the sequence described in this embodiment, the simultaneous development and collection function can be maintained while reducing the amount of the toner deposited on the first auxiliary charging brush 5. As a result, it is possible to obtain an effect such that a high-quality image can be maintained for a long period.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 118273/2011 filed May 26, 2011, which is hereby incorporated by reference.

What is claimed is:

1. An image forming apparatus comprising:

an image bearing member;

charging means for electrically charging said image bearing member;

developing means for developing with a toner an electrostatic image formed on said image bearing member simultaneously with collection of the toner remaining on said image bearing member;

transfer means for transferring a toner image, formed on said image bearing member, onto a toner image receiving material;

a first adjusting member, provided downstream of said transfer means and upstream of said charging means with respect to a rotational direction of said image bearing member, for adjusting an electric charge of the toner remaining on said image bearing member;

a second adjusting member, provided downstream of said first adjusting member and upstream of said charging means with respect to the rotational direction, for adjusting the electric charge of the toner by being supplied with a voltage of a polarity identical to a normal charge polarity of the toner; and control means for controlling said first adjusting member and said second adjusting member, wherein a predetermined first voltage is applied to said first adjusting member during a period from a time when a rear end of a region in which the electrostatic image corresponding to an image, of a series of images designated by a job, to be finally transferred onto the toner image receiving member is to be formed passes through said first adjusting member until a time when the rear end passes through said charging means, wherein the predetermined first voltage is lower in absolute value than a voltage applied to said first adjusting member until the time when the rear end passes through said first adjusting member, and wherein a predetermined second voltage is applied to said second adjusting member when a front end of a region of said image bearing member opposing said first adjusting member to which the predetermined first voltage is applied reaches said second adjusting member, wherein the predetermined second voltage is higher in absolute value than the voltage applied to said second adjusting member until the time when the front end reaches said second adjusting member.

2. An image forming apparatus according to claim 1, wherein the predetermined first voltage lower than the voltage applied to said first adjusting member during image formation is 0 V.

* * * * *